US005147571A

United States Patent [19]

DeRosa et al.

[11] Patent Number: 5,147,571

[45] Date of Patent: Sep. 15, 1992

[54] DISPERSANT, VI IMPROVER, ADDITIVE AND LUBRICATING OIL COMPOSITION CONTAINING SAME

[75] Inventors: Thomas F. DeRosa, Passaic, N.J.; Benjamin J. Kaufman, Hopewell Junction; Rosemary J. Jennejahn, Nelsonville, both of N.Y.

[73] Assignee: Texaco Inc., White Plains, N.Y.

[21] Appl. No.: 642,259

[22] Filed: Jan. 16, 1991

Related U.S. Application Data

[63] Continuation-in-part of Ser. No. 440,639, Nov. 24, 1989, abandoned.

[51] Int. Cl.[5] ..... C10M 149/06; C10M 149/10

[52] U.S. Cl. ..... 252/51.5 R; 252/51.5 A; 525/331.7; 525/332.1; 525/375

[58] Field of Search ..... 525/331.7, 332.1, 375; 252/51.5 R

[56] References Cited

U.S. PATENT DOCUMENTS 4,007,161 2/1977 Holder et al. ..... 525/331.7
4,136,136 1/1979 Dreyfuss et al . ..... 525/375
4,447,582 5/1984 Gros ..... 525/375
4,500,440 2/1985 Kaufman et al. ..... 252/51.5 A
4,715,975 12/1987 Kapusciniski et al. ..... 525/331.7
4,764,304 8/1988 Kapusciniski et al. ..... 525/331.7
4,820,776 4/1989 Kapusciniski et al. ..... 525/331.7

*Primary Examiner*—Prince Willis, Jr.
*Assistant Examiner*—Ellen McAvoy
*Attorney, Agent, or Firm*—Robert A. Kulason; James J. O'Loughlin; Vincent A. Mallare

[57] ABSTRACT

A lubricant additive prepared by the method comprising:

(a) mixing a polmer consisting of a polymerized ethylene and at least one ($C_3$–$C_{10}$) alpha-monolefin, with methyl acrylamido-glycolate methyl ether to form poly [(ethylene-c-alpha-mono-olefin) -graft-(methyl acrylamido glycolate methyl ether)];

(b) reacting said poly (methyl acrylamido glycolate methyl ether) with an amino aromatic compound to form the corresponding poly [(ethylene-co-alpha monolefin)-graft-(methyl acryl amidoglycolate)] aromatic amide; and (c) recovering said aromatic amide lubricant additive product.

19 Claims, No Drawings

DISPERSANT, VI IMPROVER, ADDITIVE AND LUBRICATING OIL COMPOSITION CONTAINING SAME

REFERENCE TO RELATED APPLICATION

This application is a continuation-in-part of coassigned U.S. patent application Ser. No. 07/440,639, filed Nov. 24, 1989, now abandoned.

BACKGROUND OF THE INVENTION

This invention relates to novel multifunctional lubricant additives which are Viscosity Index (VI) improvers and provide other performance characteristics when employed in a lubricating oil compositions.

The use of polymer additives in lubricating oil compositions is well known in the art. For example, ethyleneepropylene copolymers and ethylene-alpha olefin non-conjugated diene terpolymers which have been further derivatized to provide additional properties in lubricating oil compositions illustrate this type of oil additive.

Thus, an object of this invention is to provide a novel derivatized graft copolymer composition.

Another object of the invention is to provide a multifunctional lubricant additive effective for imparting viscosity index improvement with enhanced antioxidant and dispersant properties to the lubricating oil composition.

DISCLOSURE STATEMENT

U.S. Pat. No. 3,522,180 discloses a method for the preparation of an ethylene-propylene copolymer substrate effective as a viscosity index improver for lubricating oils.

U.S. Pat. No. 4,026,809 discloses graft copolymers of a methacrylate ester and an ethylene-propylene-alkylidene norbornene terpolymer as a viscosity index improver for lubricating oils.

U.S. Pat. No. 4,146,489 discloses a graft copolymer where the polymer backbone is an oil-soluble ethylene-propylene copolymer or an ethylene-propylene-diene modified terpolymer with a graft monomer of 2- or 4-vinylpyridine or N-vinylpyrrolidone to provide a dispersant VI improver for lubricating oils.

U.S. Pat. No. 4,340,689 discloses a process for grafting a functional organic group onto an ethylene-propylene copolymer or an ethylene-propylene-diene terpolymer.

U.S. Pat. No. 4,780,228 discloses the grafting of a hydrocarbon polymer in the absence of a solvent in the presence of a free radical initiator and a chain-terminating agent followed by a reaction with an amine, polyol or an aminoalcohol.

These disclosures, namely U.S. Pat. Nos. 3,522,180; 4,026,809; 4,146,489; 4,340,689; and 4,780,689 are incorporated herein by reference.

SUMMARY OF THE INVENTION

The present invention provides a method of preparing a lubricant additive. The process comprises:

(a) mixing a polymeric material consisting of a polymerized ethylene and at least one ($C_3$11 $C_{10}$) alpha-monoolefin, with methyl acrylamido glycolate methyl ether to form poly [(ethylene-co-alpha-mono-olefin)-graft-(methyl acrylamido glycolate methyl ether)];

(b) reacting the poly-(methyl acrylamido glycolate methyl ether) with an amino aromatic compound to form the corresponding poly [(ethylene-co-alpha-monolefin)-graft-(methyl acryl amido-glycolate)]aromatic amide; and (c) recovering the aromatic amide lubricant additive product.

DETAILED DESCRIPTION OF THE INVENTION

The invention comprises a chemical modification of ethylene-propylene copolymers or terpolymers by chemically incorporating methyl acrylamido glycolate methyl ether (I)

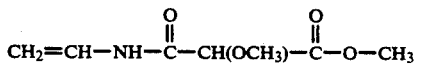

$$CH_2{=}CH{-}NH{-}\overset{\overset{\displaystyle O}{\|}}{C}{-}CH(OCH_3){-}\overset{\overset{\displaystyle O}{\|}}{C}{-}O{-}CH_3 \quad (I)$$

onto the polymeric substrate and then further derivatizing the methoxymethyl acrylamide appendage. Methyl acrylamidoglycolate methyl ether is manufactured by American Cyanamid and is available under the tradename of MAGME 100.

The present lubricant additive may also be prepared by an alternate process which comprises:

(a) mixing a polymeric material consisting of at least one ($C_3$–$C_{10}$) alpha-monolefin, with methyl acrylamido-glycolate methyl ether to form poly [(ethylene-co-alpha-mono-olefin)graft (methyl acrylamidoglycolate methyl ether)]; and (b) reacting the poly-(methyl acrylamidoglycolate methyl ether) with an alcohol to form the corresponding poly-[(ethylene-co-alpha-monoolefin)-graft-(methyl acryl-amido glycolate]ester; and (c) recovering the ester lubricant additive product.

The reactions of other materials with co-or terpolymers containing methylacrylamidoglycolate methyl ether is displacement in nature and is limited to the terminal methoxy portion of the grafted monomer. A wide variety of materials may be employed in the displacement reaction including primary and secondary alcohols; phenols; thiophenols; primary and secondary cyclic or aliphatic amines; aldol condensation reagents under basic or acidic conditions; and other organic functionality containing a primary or secondary alcohol formed under neutral conditions. Materials containing two amine functionalities may also be used providing one of these amines is tertiary in nature or non-tertiary but sterically precluded from entering in the reaction. Likewise, diols may also be used as displacement reagents provided that one alcohol is sterically precluded from entering into the reaction. Finally, materials containing both alcohol or phenol and amino functionalities may be used provided that only one group participates in the methoxy displacement. More specifically, if a material containing both amino and alcohol or phenol is used, then a tertiary or sterically hindered amine must be used to ensure the reaction is restricted to the alcohol or phenolic portion of the monomer and vice versa.

Aliphatic alcohols and amines that may be used for the derivation process are those materials that contain the aminopiperdine nucleus and are represented by the following formula:

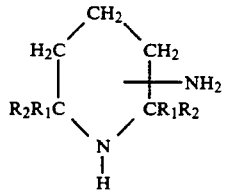

(Aminopiperdines)

where $R_1$ and $R_2$ are H or a ($C_1$–$C_5$) alky group.

Aromatic amines that may be used in the derivation reaction are primary or secondary aromatic or heteroaromatic amines selected from the group consisting of aminopyridines, aminopyrazines, and aminopyrimidines represented by the following formulas:

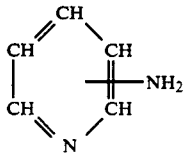

(Aminopyridines)

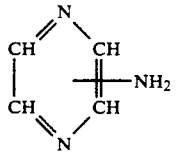

(Aminopyrazines)

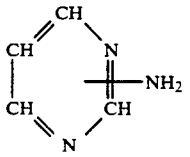

(Aminopyrimidines)

Aliphatic alcohols that can be used in the derivation process are those containing the hydroxylpiperdine structure represented by the following formula:

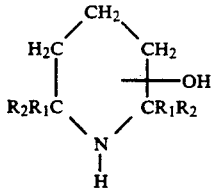

(Hydroxylpiperdines)

Phenols that may be used in the derivatizing process are hyudroxylmethylphenols represented by the following formula:

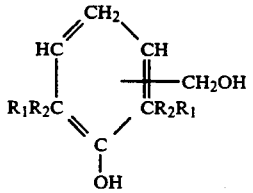

-continued (Hydroxylmethylphenols)

in which $R_1$ and $R_2$ are H or a ($C_1$–$C_5$) alkyl group.

The polymeric substrate employed as a novel additive in the present invention may be prepared from ethylene-propylene or ethylene-propylene and a higher olefin typically comprising ($C_3$–$C_{10}$) alpha-olefins.

More complex polymer substrates, often designated as interpolymers, may be prepared using a third component. The third component generally used to prepare an interpolymer substrate is a polyene monomer selected from non-conjugated dienes and trienes. This non-conjugated diene component typically has from 5 to 14 carbon atoms in the chain.

The diene monomer can include acyclic, cyclic and bicyclic compounds. Representative dienes include 1,4-hexadiene, 1,4-cyclohexadiene,dicyclopentadiene,5-ethylidene-2-norbornene,5-methylene-2-norborene, 1,5-heptadiene, and 1,6 octadiene. A mixture of more than one diene can be used in the preparation of the interpolymer. A preferred non-conjugated diene for preparing a terpolymer or interpolymer substrate is 1,4-hexadiene.

The triene component will have at least two nonconjugated double bonds, and up to about 30 carbon atoms in the chain. Typical trienes useful in preparing the interpolymer of the invention are 1-isopropylidene-3a,4,7,7a-tetrahydroindene, 1-isopropylidenedicyclopentadiene, dehydroisodicyclopentadiene, and2-(2-methylene-4-methyl-3-pentenyl)[2.2.1]bicyclo-5-heptene.

The polymerization reaction to form the polymer substrate is generally carried out in the presence of a catalyst in a solvent medium. The polymerization solvent may be any suitable inert organic solvent that is liquid under reactions conditions for solution polymerization of monoolefins which is generally conducted in the presence of a Ziegler-Natta type catalyst. Examples of satisfactory hydrocarbon solvents include straight chain paraffins having from 5–8 carbon atoms, with hexane being preferred. Aromatic hydrocarbon, preferably aromatic hydrocarbon having a single aromatic nucleus, such as benzene, toluene and the like; and saturated cyclic hydrocarbons having boiling point ranges approximating those of the straight chain paraffinic hydrocarbons and aromatic hydrocarbons described above, are particularly suitable. The solvent selected may be a mixture of one or more of the foregoing hydrocarbons. It is desirable that the solvent be free of substances that will interfere with the Ziegler-Natta polymerization process.

In a typical preparation of the polymer substrate, hexane is first introduced into a reactor and the temperature in the reactor is raised moderately to about 30° C. Dry propylene is fed to the reactor until the pressure reaches about 40–45 inches of mercury. The pressure is then increased to about 60 inches of mercury and dry ethylene and 5-ethylidene-2-norbornene are fed to the reactor. The monomer feeds are stopped and a mixture of aluminum sesquichloride and vanadium oxytrichloride are added to initiate the polymerization reaction. Completion of the polymerization reaction is evidenced by a drop in the pressure in the reactor.

Ethylene-propylene or ethylene-propylene-higher alpha monoolefin terpolymers may consist of from about 15 to 80 mole percent ethylene and from about 20 to 85 mole percent propylene or higher monoolefin with the preferred mole ratios being from about 25 to 80 mole percent ethylene and from about 20 to 75 mole percent of a ($C_3$–$C_{10}$) alpha monoolefin with the most preferred proportions being from 55 to 80 mole percent ethylene and 20 to 45 mole percent propylene.

Terpolymer variations of the foregoing polymers may optionally contain from about 0.1 to 10 mole percent of a polyene monomer selected from non-conjugated dienes or trienes. The polyene may form from about 0 to 15 mole percent of the polymer.

The polymer substrate, that is the ethylene-propylene copolymer or terpolymer is an oil-soluble, substantially linear, rubbery material having a number average molecular weight from about 5,000 to 500,000 with a preferred number average molecular weight range of 25,000 to 250,000 and a most preferred range from about 50,000 to 150,000.

The terms polymer and copolymer are used generically to encompass ethylene-propylene copolymers, terpolymers or interpolymers. These materials may contain minor amounts of other olefinic monomers so long as their basic characteristics are not materially changed.

Methylacrylamidoglycolate methyl ether may be grafted onto the polymer backbone in a number of ways. It may be grafted onto the backbone by a thermal process known as the "ene" process or by grafting in solution using a free radical initiator. If methoxymethyl acrylamide is grafted to a polymeric substrate in solution, the preferred solvents are mono-aromatic, e.g., benzene, toluene, and the like.

To ensure relatively high grafting levels, the reaction is carried out in an inert atmosphere and at an elevated temperature in the range of about 100° C. to 250° C., preferably 120° C. to 190° C., and more preferably at 150° C. to 180° C., e.g. above 160° C., in a hydrocarbon solvent, such as a mineral lubricating oil solution, containing, 1 to 50 wt %, preferably 20 to 40 wt %.

The free radical initiators which may be used to chemically graft methoxy methyl acrylamide to the polymer backbone are peroxides, hydroperoxides, and azo compounds and preferably those that compose thermally within the grafting temperature range to provide free radicals. Representative of these free radical initiators are dicumylperoxide and 2,5-dimethyl-hex-3-yne-2,5-bis tertiary-butyl peroxide. The initiator is used in an amount of between 0.005% and about 2% by weight based on the weight of the reaction mixture solution. The grafting is preferably carried out in an inert atmosphere, preferably nitrogen. The resulting polymer is characterized by having methoxymethyl acrylate functions within its structure.

Polymer substrates or interpolymers are available commercially. Particularly useful are those containing from about 40 to 60 mole percent ethylene units, about 60 to 40 mole percent propylene units. Examples are "Ortholeum 2052" and "PL-1256" available from E. I. duPont denemours and Co. The former is a terpolymer containing 48 mole percent ethylene units, 48 mole percent propylene, and 4 mole percent 1,4-hexadiene units, having an inherent viscosity of 1.35. The latter is a similar polymer with a inherent viscosity of 1.95. The viscosity average molecular weights of the two are on the order of 200,000 and 280,000, respectively.

The polymer intermediate possessing a methylacrylamidoglycolate methyl ether function is reacted with aminopiperidine or hydroxylpiperdine or with aminoaromatic compounds from the group consisting of aminopyridines, amino pyrazines, and amino pyrimidines, or hydroylmethylphenols represented by the following formulas:

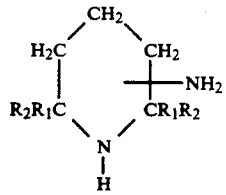
(Aminopiperdines)

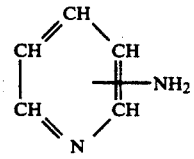
(Aminopyridines)

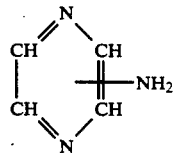
(Aminopyrazines)

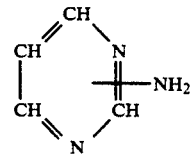
(Aminopyrimidines)

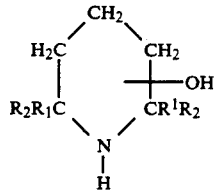
(Hydroxylpiperdines)

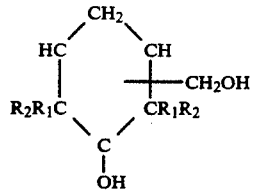
(Hydroxylmethylphenols)

in which $R_1$ and $R_2$ are H or a ($C_1$–$C_{18}$) alkyl group.

Examples of aminopiperdines include 3-amino-2,2,6,6-tetramethyl-piperdine, 4-amino-2,2,6,6-tetramethyl-piperdine, 3-aminomethyl-2,2,6,6-tetramethyl piperdine, 3-(2-amino-n-propyl)-2,2,6,6-tetramethyl piperdine, 4-(2-amino-n-propyl)-2,2,6,6-tetramethyl-piperdine, and 4-(1-amino-n-butyl)-2,2,6,6-tetramethylpiperdine. Examples of hydroxylpiperdines include 3-hydroxyl-2,2,6,6- tetramethyl piperdine, 4-hydroxyl-2,2,6,6- tetramethyl piperdine,3-hydroxyl-2,2,6,6-tetramethylpiperdine N-oxide, 4-hydroxyl-2,2,6,6-tetramethyl piperdine N-oxide, 3-hydroxylmethyl-2,2,6,6-tetramethyl-piperdine, and 4-hydroxymethyl-2,2,6,6-tetramethyl piperdine.

Examples of aminopyridines include 2-aminopyridine, 4-aminopyridine, 2-amino-4-methylpyridine, 2-(aminoethyl) pyridine, 2-(amino-n-propyl)pyridine, 4-(amino-n-propyl)pyridine and aminopyrazine and aminopyrimidine. Examples of suitable phenols includes 2,6-di-tertiarybutyl-4-hydroxymethylphenol, 4-methoxy-phenol, and 2,4-di-tertiarybutyl-6-methoxymethylphenol.

The reaction between the polymer substrate intermediate having grafted thereon methoxymethyl acrylamide function and the prescribed alcohol, phenol, amine, or aromatic amine is conducted by heating a solution of the polymer substrate under inert conditions and then adding either alcohol, phenol, amine or aromatic amine to the heated solution with stirring to effect the reaction. It is convenient to employ an oil solution of the polymer substrate heated to 140° to 175° C. while maintaining the solution under a nitrogen blanket. Either the alcohol, phenol, amine, or aromatic amine is added to this solution and the reaction is effected under these conditions.

The following examples illustrate the preparation of the novel reaction product additive of this invention.

EXAMPLE 1

Preparation of OCP-g-methyl acrylamidoglycolate methyl ether

Two hundred grams of polymeric substrate consisting of about 60 mole percent ethylene and 40 mole percent propylene and having a number average molecular weight of 80,000 was dissolved in 1440 grams of solvent neutral oil at 160° C. using a mechanical stirrer while the mixture was maintained under a blanket of nitrogen. After the rubber was dissolved, the mixture was heated an additional hour at 160° C. Ten grams of methoxymethylacrylamide dissolved in 10 grams of solvent neutral oil was added to the above mixture along with 2.5 grams dicumyl-peroxide also dissolved in 10 grams of oil. The mixture reacted for 2.5 hours at 160° C. then filtered through a 200 mesh screen.

EXAMPLE II

Reaction of OCP-g-methylacrylamidoqlycolate methyl ether with 4-hydroxyl-2,2,6,6-tetramethyl piperdine Twenty six grams of the aforementioned graft copolymer was dissolved in 174 grams of solvent neutral oil at 160° C. using mechanical stirring under a nitrogen blanket. Solid 4-hydroxyl- 2,2,6,6-tetramethyl piperdine (1.1 grams) was added to the mixture and the reaction heated for an additional two hours under the aforementioned conditions. The mixture was then cooled to 120° C. and filtered through a 200 mesh filter.

EXAMPLE III

Reaction of OCP-g-methylacrylamidoglycolate methyl ether with 4-amino-2,2,6,6-tetramethyl piperdine 4-amino-2,2,6,6-tetramethyl piperdine may be substituted in the aforementioned illustration using OCP-g-methylacrylamidoglycolate methyl ether.

EXAMPLE IV

Reaction of OCP-g-methylacrylamidoglycolate methyl ether with 2-amino pyridine 2-amino pyridine may be substituted in the aforementioned in the aforementioned illustration using OCP-g-methylacrylamidoglycolate methyl ester.

EXAMPLE V

Reaction of OCP-g-methylacrylamidoglycolate methyl ether with 2,6-di-tertiary butyl-4-hydroxymethylphenol 2,6-di-tertiarybutyl-4-hydroxymethylphenol may be substituted in the aforementioned illustration using OCP-g-methylacrylamidoglycolate methyl ether.

EXAMPLE VI

Reaction of OCP-g-methylacrylamidoglycolate methyl ether with aminopyrimidine Aminopyrimidine may be substituted in the aforementioned illustration using OCP -g-methylacrylamidoglycolate methyl ether.

EXAMPLE VII

Reaction of OCP-g-methylacrylamidoglycolate methyl ether with aminopyrazine

Aminopyrazine may be substituted in the aforementioned illustration using OCP-g-methylacrylamidoglycolate methyl ether.

The novel graft and derivatized polymer of the invention is useful as an additive for lubricating oils. They are multifunctional additives for lubricants providing dispersancy, and/or antioxidancy as well as viscosity index improvement propertities to lubricating oils. They can be employed in a variety of oils of lubricating viscosity including natural and synthetic lubricating oils and mixtures thereof. The novel additives can be employed in crankcase lubricating oils for spark-ignited and compression-ignited internal combustion engines.

The compositions can also be used in gas engines, or turbines, automatic transmission fluids, gear lubricants, metal-working lubricants, hydraulic fluids, and other lubricating oil and grease compositions. Their use in motor fuel compositions is also contemplated.

The base oil may be a natural oil including liquid petroleum oils and solvent-treated or acid-treated mineral lubricating oils of the paraffinic, naphthenic and mixed paraffinic-naphthenic types.

In general, the lubricating oil composition of the invention will contain the novel reaction product in a concentration ranging from about 0.1 to 30 weight percent. A preferred concentration range for the additive is from about 1 to 15 weight percent based on the total weight of the oil composition.

Oil concentrates of the additive may contain from about 1 to 50 weight percent of the additive reaction product in a carrier or diluent oil of lubricating oil viscosity.

The novel additive reaction product of the invention is tested for its effectiveness as a dispersant and as an antioxidant in a formulated lubricating oil composition. The base lubricating oil used in the dispersancy test is a typical formulated lubricating oil with representative values illustrated below in Table I.

TABLE I

| Component | Parts By Wgt. |
|---|---|
| Solvent neutral oil A | 75.25 |
| Solvent neutral oil B | 21.64 |
| Zinc Dialkyldithioposphate | 1.22 |
| 4.4'dinonyldiphenylamine | .39 |
| Overbased magnesium sulfonate | 1.50 |
| Silicone anifoamant | 150 PPM |
| Product | 10 |

In Table I, above, oil A has a sp. gr. 60°/60° F. of 0.858–0.868; vis 100° F. 123–133; Pour Point 0° F. Oil B has a sp. gr. 60°/60° C. of 0.871–0.887; Vis 100° F. 325–350; Pour Point +10° F. Zinc salt is a salt of mixed alcohols-ispropanol and $P_2P_2$ product as described in U.S. Pat. No. 3,292,181. The overbased magnesium sulfonate has a TBN of 395 and is a salt of branched ($C_{20}$–$C_{40}$) monoalkybenzene sulfuric acid (MW 530–540) together with about 10% magnesium carbonate, 14% magnesium hydroxide and 4% magnesium sulfate.

The dispersant properties of the additive-containing oil were determined in the Bench VC Dispersancy Test (BVCT). Dispersancy of a lubricating oil were determined relative to three reference results from three standard blends tested with the unknown. The test additives were blended into a formulated oil containing no dispersant. The additive reaction product was employed in the oil at a concentration of 12.0 weight percent polymer solution. The numerical value of the test results decreases with an increase in effectiveness. Results of the Bench VC Testing are summarized below in Table II.

TABLE II

| BENCH VC DISPERSANCY TEST | |
|---|---|
| VI Improver | BVCT |
| Example 1 (underivatized OCP-g-methylacrylamidoglycolate methyl ether) | 92 |
| Example 2 | 16 |
| Example 4 | 27 |
| Example 5 | 38 |
| OCP | 99 |
| Commercial NVP grafted DOCP | 68 |

The OCP base rubber and number average molecular weight are similar in all illustrations in Table II above.

The anti-oxidant properties of the novel reaction product in a lubricating oil were determined in the Bench Oxidation Test. In this test, 1.5 weight percent of the additive reaction product was blended into solvent neutral oil (S.U.S. at 100° F. of 130). The mixture was continuously stirred while being heated accompanied by bubbling with air. Samples were withdrawn periodically for analysis by Differential Infrared Absorption (DIR) to observe changes in the intensity of the carboxyl vibration band at 1710 $cm^{-1}$. A low carboxyl vibration band intensity indicates higher thermal-oxidative stability of the sample. Results of Bench Oxidation Testing are summarized below, in Table III.

TABLE III

| BENCH OXIDATION TEST | | |
|---|---|---|
| Run | Additive | Results |
| 1 | Example I | 6.2 |
| 2 | Example II | 3.4 |
| 3 | Commercial N-vinylprrolidone-grated dispersant olefin copolymer (DOCP) | 15 |

The test results for Examples I and II demonstrate substantial improvements in anti-oxidant properties due to incorporation of the novel reaction product of the invention in an oil composition as compared to the results obtained using a known dispersant VI improver and the underivatized graft block copolymer rubber.

We claim:

1. A method of preparing a lubricant additive comprising:

(a) mixing a polymer consisting of a polymerized ethylene and at least one ($C_3$–$C_{10}$) alpha-monolefin, with methyl acrylamidoglycolate methyl ether at a temperature of about 100°–250° C. under a blanket of $N_2$ to from poly [(ethylene-co-alpha-mono-olefin-graft-(methylacrylamide-glycolate methyl ether ];

(b) reacting said poly-(methyl acrylamidoglycolate methyl ether) with an amino aromatic compound to form the corresponding poly [(ethylene-co-alpha-monolefin)-graft-(methyl acryl amidoglycolate)] aromatic amide; and (c) recovering said aromatic amide lubricant additive product.

2. The method of claim 1 wherein said polymer is prepared from ethylene and at least one ($C_3$–$C_{10}$) alpha-monoolefin and optionally a polyene selected from non-conjugated diens and trienes comprising from about 15 to 80 mole percent of ethylene from about 20 to 85 mole percent of said ($C_3$–$C_{10}$) alpha-monoolefin and from about 0 to 15 mole percent of said polyene and having a number average molecular weight ranging from about 5,000 to 500,000.

3. The method of claim 2 wherein said amino aromatic compound is selected from the group consisting of aminopyridines, aminopyrazines, and aminopyrimidines represented, respectively, by the following formulas:

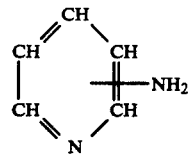

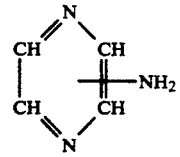

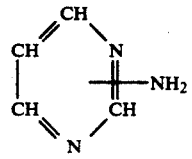

4. The method of claim 1 wherein said amino aromatic compound is selected from the group consisting of: 2-amino pyridine; aminopyrimidine; and aminopyrazine.

5. A method of preparing a lubricant additive comprising:

(a) mixing a polymer consisting of a polymerized ethylene and at least one ($C_3$–$C_{10}$) alpha-monolefin, with methyl acrylamidoglycolate methyl ether to form poly [(ethylene-co-alpha-mono-olefin)-graft-(methyl acrylamide-glycolate methyl ether)$\pi$;

(b) reacting said poly-(methyl acrylamidoglycolate methyl ether) with an alcohol to form the corresponding poly [(ethylene-co-alpha-monolefin)-graft-(methyl acryl amido glycolate)] ester; and (c) recovering said ester lubricant additive product.

6. The method of claim 5, wherein the alcohol is an aliphatic alcohol or a phenol.

7. The method of claim 5, wherein said alcohol is selected from the group consisting of: 4-hydroxyl-2,2,6,6-tetramethyl piperidine; and 2,-6-di-tertiary butyl-4-hydroxymethylphenol.

8. The method of claim 6 wherein said aliphatic alcohol or phenol compound is selected from the group consisting of hydroxylpiperdine or hydroxylmethylphenols represented by the following formulas:

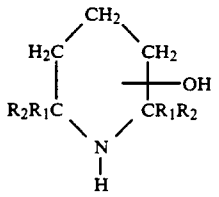

-continued

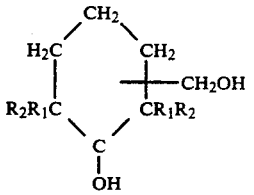

in which $R_1$ and $R_2$ are H or a ($C_1$–$C_5$) alkyl group.

9. The method of claim 2 wherein said polymer has a number average molecular weight from about 50,000 to 500,000.

10. The method of claim 2 wherein said polymers has a number average molecular weight from about 50,000 to 150,000.

11. The method of claim 2 wherein said polymer comprises from about 25 to 80 mole percent ethylene and from about 20 to 75 mole percent of a $C_3$ to $C_{10}$ alpha-monoolefin.

12. The method of claim 2 wherein said polymer comprises from about 55 to 80 mole percent ethylene and from about 20 to 45 mole percent of propylene.

13. The method of claim 2 wherein said polymer contains from about 0.1 to 10 mole percent of a polyene.

14. The method of claim 4 wherein said amino aromatic compound is 2-aminopyridine.

15. The method of claim 4 wherein said amino aromatic compound is 2-aminopyridine.

16. The method of claim 4 wherein said amino aromatic is 4-amino-2,2,6,6-tetramethyl-piperdine.

17. The method of claim 7 wherein said alcohol is 4-hydroxyl-2,2,6,6-tetramethyl-piperdine.

18. The method of claim 7 wherein said alcohol is 2,6-ditertiarybutyl-4-hydroxylmethyl-phenol.

19. The method of claim 4 wherein said amino aromatic compound is 2-aminopyrazine.

* * * * *